United States Patent [19]

Mendenhall

[11] 4,387,996

[45] Jun. 14, 1983

[54] BATCH METHOD OF RECYCLING ASPHALTIC CONCRETE

[76] Inventor: Robert L. Mendenhall, 1770 Industrial Rd., Las Vegas, Nev. 89102

[21] Appl. No.: 262,553

[22] Filed: May 11, 1981

Related U.S. Application Data

[63] Continuation-in-part of Ser. No. 139,640, Apr. 14, 1980, Pat. No. 4,326,809, and a continuation-in-part of Ser. No. 180,297, Aug. 22, 1980, each is a continuation-in-part of Ser. No. 1,051, Jan. 28, 1979, Pat. No. 4,219,278, which is a continuation-in-part of Ser. No. 871,351, Jan. 23, 1978, Pat. No. 4,208,131, and a continuation-in-part of Ser. No. 906,734, May 17, 1978, Pat. No. 4,240,754.

[51] Int. Cl.[3] ..... B28C 5/04; B28C 5/20

[52] U.S. Cl. ..... 366/4; 366/7; 366/14; 366/25; 366/37

[58] Field of Search ..... 366/2–4, 366/7, 8, 14, 15, 22, 23, 24, 25, 37, 154, 177, 235; 106/281 R; 432/106

[56] References Cited

U.S. PATENT DOCUMENTS

| | | | |
|---|---|---|---|
| 1,703,864 | 3/1929 | Arnold | 366/4 |
| 3,999,743 | 12/1976 | Mendenhall . | |
| 4,075,710 | 2/1978 | Jakob et al. | 366/25 |
| 4,096,588 | 6/1978 | Mendenhall | 366/7 |
| 4,104,736 | 8/1978 | Mendenhall | 366/2 |
| 4,147,436 | 4/1979 | Garbelman et al. | 106/281 R X |
| 4,165,184 | 8/1979 | Schlarmann | 366/24 X |

OTHER PUBLICATIONS

Construction Bulletin, Oct. 1, 1976, "Hot Mix Recycling Project is Nation's First Using Conventional Equipment".

Recycling Report, vol. 1, No. 1, May 27, 1977, "State of the Art: Hot Recycling".

*Primary Examiner*—Philip R. Coe
*Assistant Examiner*—Joseph M. Pitko
*Attorney, Agent, or Firm*—Jerry R. Seiler

[57] ABSTRACT

A batch method of producing asphalt-aggregate composition having a temperature of at least about 200° F. and at least about 20% used asphaltic concrete comprises heating solid particles of the used material in a first drum to a temperature of at least about 150° F., separately heating virgin aggregate in a second drum to a temperature of less than about 400° F., and mixing the two materials, preferably with the addition of hot liquid or paving grade asphalt. In a second embodiment, unheated used asphaltic concrete is mixed with heated used asphaltic concrete and heated virgin aggregate.

8 Claims, 1 Drawing Figure

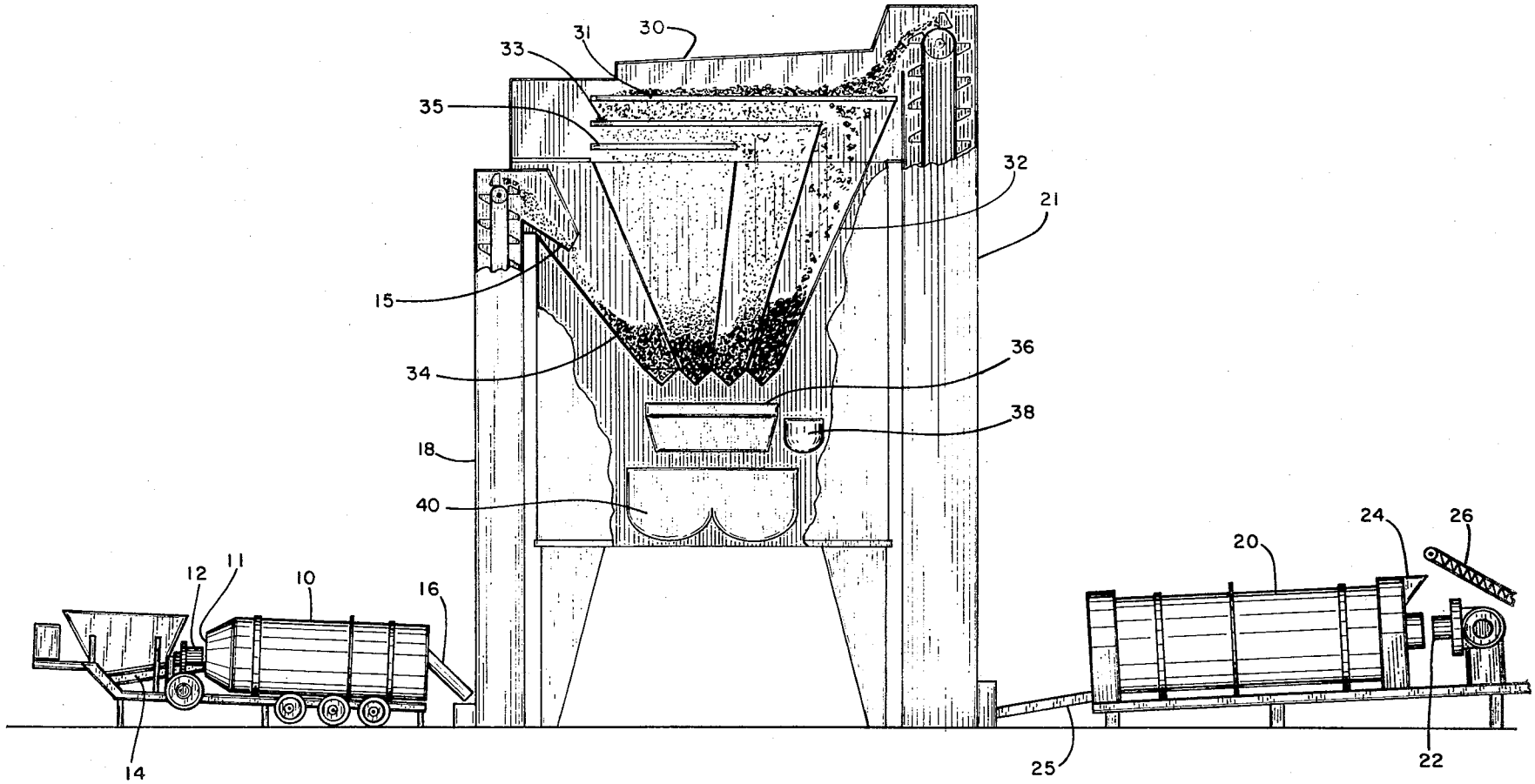
26
24
20
22
25
21
32
36
38
30
31
33
35
15
34
18
40
16
10
11
12
14

BATCH METHOD OF RECYCLING ASPHALTIC CONCRETE

REFERENCE TO OTHER APPLICATIONS

This application is a continuation-in-part of application Ser. Nos. 139,640, filed Apr. 14, 1980, now U.S. Pat. No. 4,326,809, and 180,297, filed Aug. 22, 1980, which are continuations-in-part of application Ser. No. 1,051, filed Jan. 28, 1979, now U.S. Pat. No. 4,219,278 which is a continuation-in-part of Ser. No. 871,351, filed Jan. 23, 1978, now U.S. Pat. No. 4,208,131, and Ser. No. 906,734, filed May 17, 1978, now U.S. Pat. No. 4,240,754.

BACKGROUND OF THE INVENTION

Although batch processing as a method of recycling asphaltic concrete has been practiced, such a process has not been satisfactory, primarily due to the substantial limitation of the amount of used or reclaimed asphaltic concrete that can be incorporated in the final product. In that method, the asphaltic concrete to be recycled is mixed with super heated virgin aggregate to produce the recycle mix. Because the used asphaltic concrete is not heated prior to being mixed with the hot aggregate, the latter must be heated to very high temperatures in order to achieve a recycle mix having adequately high temperatures for use, generally preferably above about 225° F., and more preferably above about 250° F. For many practical uses, it is desired to have mix temperatures of around 275°-300° F. or higher, so it becomes apparent in order to achieve such temperatures, substantial super heating of the virgin aggregate must be accomplished.

Where small amounts of the reclaimed material are to be used in the recycle mix, to achieve a product in the desired temperature range, virgin aggregate super heating in the 300° F. range may be suitable. However, where it is desirable to include as much reclaimed material as possible in the final product, much higher aggregate temperatures are required. Indeed, heretofore, because of such limitations, the maximum amount of reclaimed material which it has been possible to use in the recycled mix in a batch process of this type has been reported to be about 50%. For example, for a final 225° F. mix temperature, assuming zero moisture in the reclaimed material and ambient material temperature of 50° F., virgin aggregate temperatures of about 400° F. are required, whereas at about 4% moisture, aggregate temperatures must be about 600° F., assuming no heat loss during processing and mixing. For final recycle mix temperatures of 260° F., with zero moisture in the reclaimed material, virgin aggregate temperatures of almost 500° are required; with 2% moisture, the aggregate must be super heated to almost 600° F., and at 4% moisture, to about 675°. Obviously, such extreme aggregate temperatures present significant problems in heating the material in conventional dryer drums and in handling the material before it is mixed with the ambient reclaimed material. Moreover, with aggregate temperatures of above about 300° F., there are also substantial problems of asphalt deterioration and burning as the super hot aggregate is initially exposed to the asphalt present in the reclaimed material.

Attempts to avoid such problems in batch processing have not been accomplished heretofore because of the inherent limitations in heating the reclaimed material by direct exposure to hot gases of combustion in conventional dryer drum apparatus. To specifically avoid burning the asphalt in the reclaimed material, alternate methods have been proposed such as described in my U.S. Pat. No. 4,177,080 and those of others such as U.S. Pat. Nos. 4,075,710 and 4,165,184. These patents, utilizing other than the batch processing for producing the recycle mix, protect the reclaimed material in a heating drum by exposing it only to cooler gas temperatures along the heating drum interior than those hot gases to which the virgin aggregate is exposed.

SUMMARY OF THE INVENTION

In the present invention, an improved batch processing for recycling asphaltic concrete is proposed. In the process, the reclaimed material is heated to desirable temperatures of at least 150° F., and up to about 325° F., if desired, by direct exposure to flame and hot gases of combustion, utilizing applicant's apparatus and method, and by separately heating virgin aggregate in a conventional dryer drum apparatus to temperatures of 400° F., or lower, far below those required for previous batch recycling processes, to achieve product temperature of between about 200 and about 325° F.

BRIEF DESCRIPTION OF THE DRAWING

The drawing shows the apparatus utilized in the process of the invention.

DETAILED DESCRIPTION OF THE INVENTION

The present invention is directed to a novel and improved method of preparing a recycled asphaltic concrete composition in a batch process in which the reclaimed or used asphaltic concrete particles are heated by direct exposure to flame and hot gases of combustion in a separate apparatus from that in which virgin aggregate is heated. As shown in the drawing, the apparatus for heating the reclaimed or used asphaltic concrete particles is a drum 10 having a port 11 at one end, open to atmosphere, and into which flame and hot gases of combustion from burner 12 are directed. In a preferred embodiment, the used asphaltic concrete particles are also introduced into the drum at open port 11 using a convenient feeder apparatus such as a conveyer 14. In drum 10 the asphaltic concrete particles are alternately exposed to the flame and hot gases of combustion directed into port 11 as the drum is rotated. Such an apparatus is disclosed in my aforesaid co-pending applications, including a suitable crushing and feeding apparatus which may conveniently be used for providing uniformly and suitably sized asphaltic concrete particles to be introduced into the drum 10.

A significant and critical feature of the process of the present invention is in exposing the used asphaltic concrete particles directly to hot gases of combustion so that they may be adequately heated prior to being mixed with hot aggregate, and so that the aggregate does not have to be super heated to extreme temperatures as has been required in previously used batch methods. Such direct heating of asphaltic concrete particles in recycling operations has not been utilized in batch recycle processes heretofore, because of the substantial danger of burning the highly flammable asphalt fines, resulting in unacceptable smoke and other visible emissions. The process of the present invention avoids such a disadvantage. Instead, because of the unique features of my apparatus, referred to hereinafter as a "closed end drum", volatile hydrocarbons emitted from the heating asphalt in drum 10 are combusted or oxidized within the drum prior to being vented to atmosphere, unlike conventional dryer drum apparatus. Instead, the product recovery port present at or near the opposite end of drum 10 from port 11, into which the hot gases are directed, is substantially closed, except to the extent needed to recover product.

Of particular advantage is the use of a chute 16 which may be retractable as disclosed in my later filed aforesaid co-pending application or of other design for exposing more or less of the chute within the drum to recover composition of a selected temperature. Utilizing such a chute, product of any desired temperature within the range of above about 150° F., and up to 300°–325° F., may be recovered by inserting chute 16 more or less into the drum to retrieve the product having the desired temperature. My aforesaid co-pending applications describe such product recovery including apparatus for sensing product temperature in the drum and automatically varying the exposure of the chute within the drum to recover a product having a selected temperature and those descriptions are incorporated herein by reference.

Although the preferred apparatus is as shown, with used asphaltic concrete particles being introduced into drum 10 at port 11 and recovered at the opposite end, for certain batch applications, recovery of the product through the same port 11 may be accomplished. Apparatus of that type is disclosed in my U.S. Pat. No. 4,208,131 and application Ser. No. 906,734, filed May 17, 1978, now U.S. Pat. No. 4,240,754 the descriptions of which are incorporated herein. Alternatively, still other apparatus which may be suitable for heating the used asphaltic concrete particles are those closed end drum apparatus disclosed in my co-pending applications Ser. Nos. 139,708, and 139,709 filed Apr. 14, 1980. The description of these additional apparatus are also incorporated herein by reference. The common feature of all such apparatus suitable in the process of the present invention is in exposing the asphalt-containing reclaimed asphaltic concrete particles directly to hot gases of combustion, and concurrently oxidizing the asphalt hydrocarbon volatiles within the drum prior to being vented to atmosphere.

In the more preferred embodiment, as shown in the drawing, the hydrocarbon volatiles oxidized in the drum are vented to atmosphere along with the exhaust gases from the burner concurrently with introduction of the hot gases of combustion through the same port. This unique method is unlike previous methods using conventional dryer drum apparatus in which the exhaust gases and hydrocarbon volatiles are vented directly through the drum at the opposite drum end from the burner, and either vented to atmosphere or commonly treated to remove objectionable atmospheric pollutants. Instead, in the present invention, substantially all of the gases from within the drum are vented directly to atmosphere through port 11 concurrently with the introduction of hot gases of combustion therein, without special treatment, since the objectionable hydrocarbon volatiles from the asphalt have been oxidized within the drum during the heating process.

The hot asphaltic concrete from drum 10 directed from chute 16 is elevated in a suitable apparatus such as a bucket elevator 18 to chute 15 and into hot bin 23. The heated virgin aggregate is supplied to gradation control unit 30 from conventional dryer drum 20, the virgin material supplied via conveyor 26 into hopper 24, with hot gases supplied into the drum from burner 22. Gradation control unit 30 includes a plurality of screens 31, 33 and 35 which separate aggregate into various size ranges, passing them into the hot bins 32. The selected mixture of sized aggregates together with the hot reclaimed material from bin 34 is measured into weight hopper 36, and then into pugmill 40. Weigh bucket 38 measures the desired amount of liquid asphalt to be added to the batch of material in the pugmill.

According to the invention, the temperature of the heated virgin aggregate will be less than about 400° F., and may be as low as or lower than the temperature of the desired final product mix if the used asphaltic concrete has been sufficiently heated. Since the reclaimed material may be heated up as high as 325° F. utilizing the above described apparatus, if a similar final product temperature is desired, the virgin aggregate need only be heated to that temperature. Where greater amounts of reclaimed material is used, which may be up to even 99+% of the mix, the aggregate temperature may even be less than that of the reclaimed material. Thus, for example, if the recycle mix uses a reclaimed: aggregate ratio of 80:20 and a final temperature of 250° F. is desired, the reclaimed material may be heated to 275° F. while the aggregate need only be heated to 150° F. Accordingly, in the process of the present invention, the reclaimed asphaltic concrete is heated to at least about 150° F. and up to about 325° F. and utilizing at least about 20% reclaimed material to achieve a recycle mix product having a temperature between about 200° F. and about 325° F., and preferably between about 225° F. and about 300° F., with the specific amount of aggregate selected so that it will be heated at a temperature of below about 400° F. and preferably below about 350° F. It will be understood, of course, that some temperature loss will occur during the processing.

The following table further illustrates the advantage of the process of the invention over the conventional, state of the art batch technique in which the used material is not heated, but is at ambient temperature, assumed to be 50° F. The table gives the temperature of the used (reclaimed) material, and required virgin aggregate temperature to achieve a final product having the temperature shown. Moreover, the temperatures given assume no heat loss in processing and mixing the materials following heating.

| Ratio | Temperature °F. | | |
|---|---|---|---|
| Used/Virgin | USED | FINAL | VIRGIN |
| 20/80 | 50 | 300 | 374 |
| 20/80 | 150 | 300 | 338 |
| 20/80 | 250 | 300 | 313 |
| 50/50 | 50 | 300 | 550 |
| 50/50 | 200 | 300 | 400 |
| 50/50 | 250 | 300 | 350 |
| 80/20 | 50 | 225 | 925 |
| 80/20 | 250 | 225 | 125 |
| 80/20 | 50 | 300 | 1300 |
| 80/20 | 150 | 300 | 900 |
| 80/20 | 250 | 300 | 500 |
| 80/20 | 275 | 300 | 400 |

From the results shown in the table, it is seen that by heating the used composition to at least about 150° F. according to the invention, the virgin aggregate heating requirements are substantially reduced. It will normally be necessary to add additional paving grade asphalt to the composition mixture in preparing the final recycle mix product. The amount of asphalt will depend on the relative amounts of the virgin aggregate and reclaimed asphaltic concrete used as well as the amount and condition of the asphalt in the asphaltic concrete. Softening agents such as those disclosed in my U.S. Pat. No. 4,000,000 may be used, or a mixture of asphalt and softening agent as disclosed in my U.S. Pat. No. 4,256,506.

In yet another embodiment of the invention, where virgin aggregate is heated to a higher temperature, above 400° F., by heating only a relatively small amount of reclaimed material, a recycle mix having a suitable temperature may be made by blending in a substantial amount of unheated reclaimed asphaltic concrete resulting in a composition having over 50% used asphaltic concrete. For example, reclaimed material heated to 300° F. and recovered at 60 tons per hour utilizing the closed end drum heating apparatus, combined with 600° F. superheated aggregate from a conventional drier drum at 108 tons per hour and mixed with 194 tons per hour of unheated reclaimed material will yield 360 tons per hour of recycle mix at 257° F., assuming the ambient temperature of reclaimed material to be at 50° F. Using such figures, 16% of the recycle mix is heated used material, 30% is virgin aggregate and 54% of the composition is unheated used asphaltic concrete.

Accordingly, the process of heating and blending reclaimed material at 225°-325° F. may also be used with superheated aggregate, up to about 700° F., with accompanying increase in final product temperature, or in the increase of the amount of unheated reclaimed material blended in the mixture. Thus, by using applicant's process of heating at least a portion of the reclaimed mixture, advantages of achieving hot mixture of over about 225° F. having more than 50% reclaimed material may be prepared which has not been possible previously. Using such an embodiment, it is preferred to mix the cold and heated reclaimed material prior to blending with the hot aggregate. More preferable, the unheated reclaimed material comprises at least 50%, by weight, of the final composition. The specific relative amounts of superheated aggregate at about 400°-700° F. and heated and unheated asphaltic concrete may be selected to arrive at the desired final product temperature. Again however, it is the purpose of the present invention to incorporate over 50% used asphaltic concrete, and according to this embodiment, to preferably use 50% or more of unheated used recycle material, mixed with heated asphaltic concrete of 225° F. or more, and hot virgin aggregate. However, using this method, with the heated reclaimed material heated to 225°-325° F., substantially increased amounts of unheated used material may be used, and/or the temperature of the aggregate reduced.

By way of further example, for a desired recovery rate of 360 tons per hour, well within the normal capacity of an 8000 lb. batch plant, using 180 tons of unheated used asphaltic concrete (50%) and 36 tons of heated asphaltic concrete at 230° F. (10%), will require 144 tons of aggregate (40%) to be heated to only about 456° F. to achieve a final product of 230° F., assuming no moisture in the materials. Or, if 72 tons of 600° aggregate is used for every 360 tons of blended composition only about 30% of the composition need be heated asphaltic concrete at 300° F. while the remaining 50% of the total composition may be unheated used reclaimed material.

These as well as other embodiments within the purview of the invention will be evident to those skilled in the art.

I claim:

1. A batch method of producing an asphalt-aggregate composition at a temperature of at least about 200° F. and having at least 50% used asphaltic concrete comprising:

(a) heating particles of 100% used asphaltic concrete to a temperature of at least about 150° F. in a first drum by directly exposing said particles to hot gases of combustion, (b) heating virgin aggregate to a temperature of less than about 400° F. in a second drum, and (c) mixing the heated particles of used asphaltic concrete, virgin aggregate, and liquid asphalt to achieve said asphalt-aggregate composition.

2. A batch method of producing an asphalt-aggregate composition at a temperature of at least about 200° F. and having at least 20% used asphaltic concrete comprising:

(a) introducing solid particles of an asphaltic concrete composition comprising a mixture of asphalt and aggregate into a first drum, (b) introducing hot gases of combustion into said first drum through a first port while rotating said drum and directly exposing said asphaltic concrete composition to said hot gases, burning hydrocarbon volatiles from said asphaltic concrete composition in said drum and concurrently venting said burned volatiles substantially only through said first port concurrently with said introduction of said hot gases of combustion therein, (c) heating said asphaltic concrete composition particles in said drum to at least about 150° F. and recovering said heated asphaltic concrete composition, (d) heating non-asphalt containing aggregate particles in a second drum to a temperature up to about 400° F. and recovering the heated aggregate particles, and (e) mixing said heated asphaltic concrete composition and non-asphalt containing aggregate particles to produce said asphalt-aggregate composition.

3. The method of claim 2 including adding hot asphalt to said asphalt-aggregate composition during said mixing.

4. The method of claim 2 wherein said asphalt-aggregate composition has a temperature of between about 225° F. and about 300° F. and wherein said aggregate is heated to a temperature below about 350° F.

5. The method of claim 2, 3, or 4 wherein the amount of said used asphaltic concrete is between about 50% and about 99%, by weight.

6. A method of producing an asphalt-aggregate composition at a temperature of at least about 225° F. and having at least 50% used asphaltic concrete comprising:

(a) heating particles of 100% used asphaltic concrete to a temperature of at least about 225° F. in a first drum by directly exposing said particles to hot gases of combustion, (b) heating virgin aggregate to a temperature of above about 400° F. in a second drum, and (c) mixing the heated particles of used asphaltic concrete, virgin aggregate, and unheated asphaltic concrete particles to achieve said asphalt-aggregate composition.

7. A method of producing an asphalt-aggregate composition at a temperature of at least about 225° F. and having greater than 50% used asphaltic concrete comprising:

(a) heating solid particles of an asphaltic concrete composition comprising a mixture of asphalt and aggregate in a first drum, by introducing hot gases of combustion into said first drum through a first port while rotating said drum and directly exposing said particles to said hot gases, burning hydrocarbon volatiles from said asphaltic concrete composition in said drum and concurrently venting said burned volatiles substantially only through first port concurrently with said introduction of said hot gases of combustion therein, and heating said asphaltic concrete composition particles in said drum to at least about 225° F. and recovering said heated asphaltic concrete composition, (b) heating non-asphalt containing aggregate particles in a second drum to a temperature above 400° F. and recovering the heated aggregate particles, and (c) mixing said heated asphaltic concrete composition and heated non-asphalt containing aggregate particles with unheated asphaltic concrete composition particles to produce said asphalt-aggregate composition having a temperature of at least about 225° F.

8. The process of claim 6 or 7 wherein said unheated asphaltic concrete composition is at least about 50% of said asphalt-aggregate composition.

* * * * *